United States Patent [19]

Penney

[11] 4,149,727

[45] Apr. 17, 1979

[54] GAME APPARATUS

[76] Inventor: Jerry A. Penney, 15951 San Fernando Mission Blvd., Granada Hills, Calif. 91344

[21] Appl. No.: 863,125

[22] Filed: Dec. 22, 1977

[51] Int. Cl.[2] ..... A63F 3/00

[52] U.S. Cl. ..... 273/271

[58] Field of Search ..... 273/271, 267, 282

[56] References Cited

U.S. PATENT DOCUMENTS

| | | | |
|---|---|---|---|
| 1,521,095 | 12/1924 | Harris | 273/271 |
| 1,760,642 | 5/1930 | Graham | 273/271 |
| 3,588,113 | 6/1971 | Nelson | 273/271 |
| 3,705,727 | 12/1972 | Breslow | 273/271 |
| 3,747,926 | 7/1973 | Odom | 273/282 |
| 3,863,926 | 2/1975 | White et al. | 273/267 |

FOREIGN PATENT DOCUMENTS

| | | | |
|---|---|---|---|
| 1244174 | 8/1971 | United Kingdom | 273/271 |

*Primary Examiner*—Anton O. Oechsle
*Attorney, Agent, or Firm*—Roger A. Marrs

[57] ABSTRACT

A game apparatus is disclosed herein having a game board with a flat planar surface displaying a playing configuration or pattern including parallel rows and columns defining an odd number of playing squares. Each square is provided with indicia defining a circle enclosing or encircling an "X" and each circle and an X is provided with the same number of holes adapted to insertably receive a player token or marker. A numbered die is employed for determining the number of holes to be occupied by players tokens or numbered cards may be employed for the same purpose.

8 Claims, 4 Drawing Figures

FIG. 1
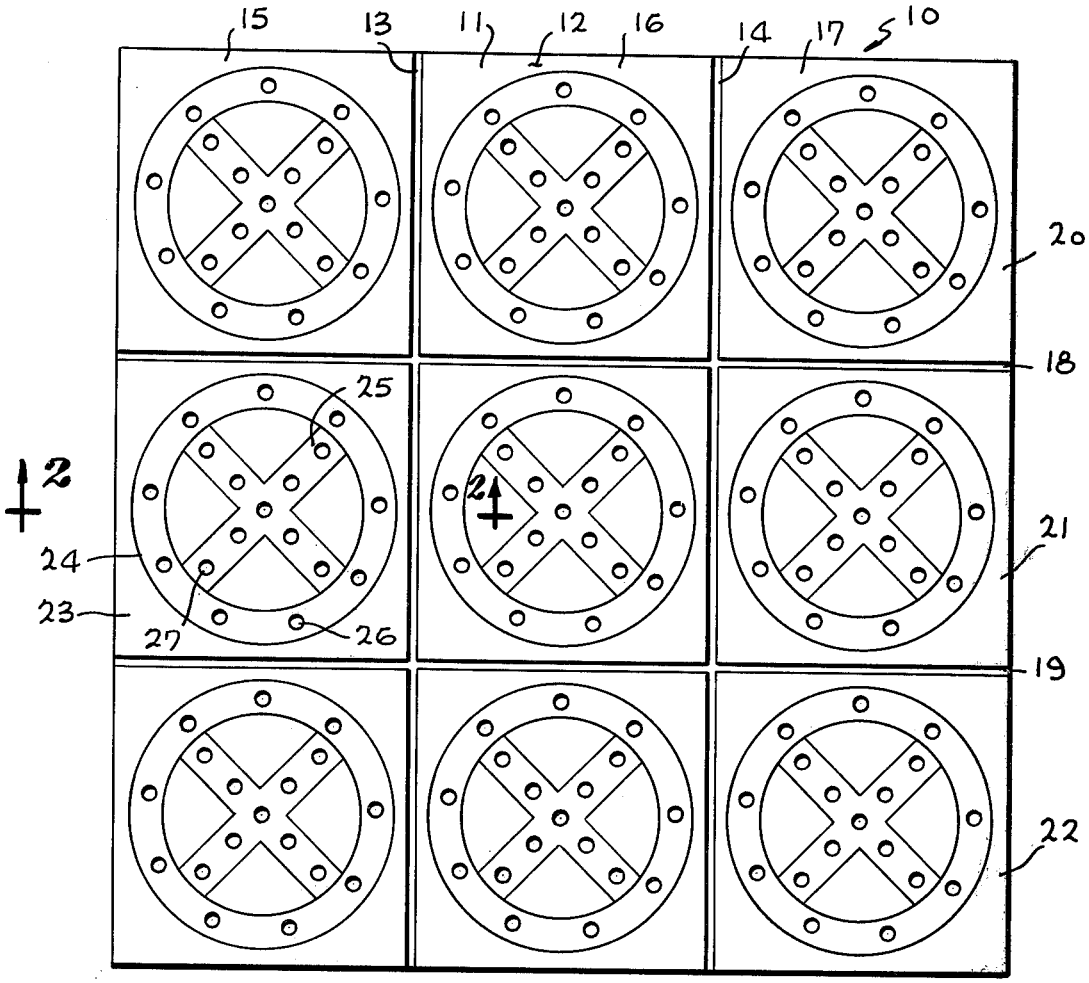
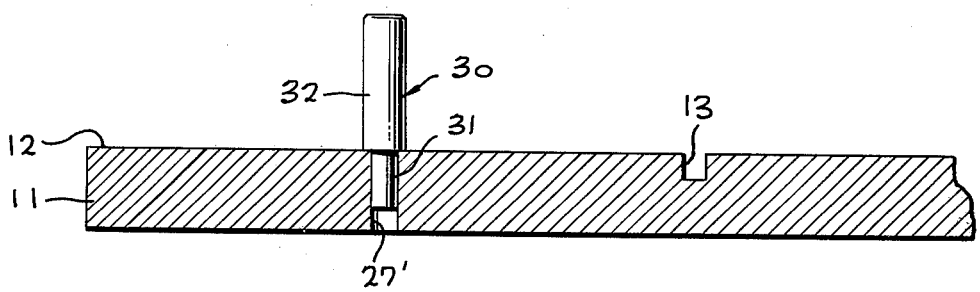
FIG. 2
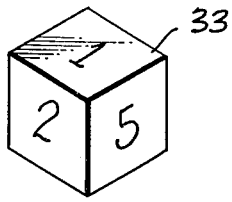
FIG. 3
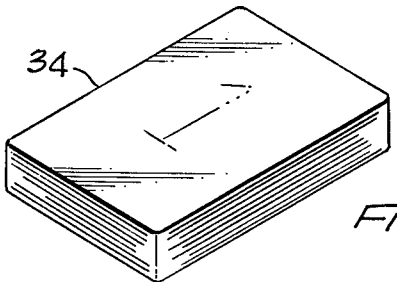
FIG. 4

GAME APPARATUS

BACKGROUND OF THE INVENTION

1. Field of the Invention

The present invention relates to game apparatus of the tick-tack-toe type and more particularly to the type of games which feature the placing of playing tokens or markers upon a playing surface as determined by chance determining means so that the arrangement of pieces or markers assumes a winning or particular pattern.

2. Brief Description of the Prior Art

Game boards have been provided in the past which have included a plurality of playing squares arranged in parallel rows and columns whereby a player's token may be arranged to occupy a selected square so that the first player to achieve a straight line occupation of squares in either a particular row, a particular column or a particular diagonal sequence wins the game. Also, a variety of versions have been provided which are disclosed in U.S. Pat. Nos. 935,755; 2,368,896 and 3,588,113. Although such prior game boards and apparatus disclose a variety of playing forms and opportunities, such conventional games do not allow for a high degree of player's skill to be employed in determining the player's length of move along a path or course in order to reach the desired pattern constituting the highest score or the winning combination. Furthermore, inasmuch as a single path or pattern is provided, the outcome of conventional games do not depend on a "winning" combination of values or patterns such as may be provided by employing multiple patterns within each game square which may be played simultaneously by each of the individual players upon the occasion of taking their turn. Consequently, most conventional games fall short of achieving intellectual stimulation in combination with chance determining means which will allow for a wide variety of games to be played upon a single board.

Therefore, a need has existed to provide a novel game board apparatus which provides multiple playing squares having at least two playing patterns defined thereon and which provides a chance determining means for moving player's tokens or markers along the patterns within the playing squares in order to achieve a winning combination.

SUMMARY OF THE INVENTION

Accordingly, the above problems and difficulties are obviated by the present invention which provides a novel game board apparatus including a planar surface having a plurality of playing squares arranged in parallel rows and columns. Each playing square is occupied by at least a pair of patterns provided with holes for insertably receiving a player's marker. Chance determining means are provided for signifying the number of markers to be placed in the holes of selected patterns in each playing square and the winning combination is achieved by occupation not only of the desired pattern within a particular square but the occupation of that pattern among multiple squares in the rows and columns.

Therefore, it is among the primary objects of the present invention to provide a novel board game apparatus having multiple playing paths or courses comprising playing squares which are simultaneously played upon by an individual player during his turn for action to effect playing combinations having different values or patterns.

It is another object of the present invention to provide a novel game board apparatus having playing spaces or areas defining at least two different patterns upon which an individual player may move tokens or markers responsive to chance determining means so as to effect a "winning" combination of spaces or patterns according to a designated configuration or pattern.

Still another object of the present invention is to provide a novel board apparatus for playing games in the use of which the outcome of the game is not entirely dependent upon the skill of the respective players in that certain elements of chance are involved in the playing of the game.

A further object of the present invention is to provide a novel game board displaying a number of different patterns or configurations and chance determining means which may be employed to play various highly amusing and interesting games and which at the same time involves sufficient player's skill to render attention, alertness and resourcefulness a large factor in the playing of the game.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

FIG. 1 is a plan view of one form or arrangement of a game board or playing field for a game in accordance with the present invention;

FIG. 2 is a fragmentary sectional view of the game board apparatus shown in FIG. 1 as taken in the direction of arrows 2—2 thereof;

FIG. 3 is a perspective view of a typical chance determining means used to determine a particular play to be followed by the player's token or marker and the direction of player token travel or placement on a particular playing pattern; and FIG. 4 is a perspective view representing a deck of ordinary playing cards which may be employed during the play of the game as chance determining means as an alternate to the die shown in FIG. 3.

DESCRIPTION OF THE PREFERRED EMBODIMENT

Referring to FIG. 1, the layout of a game board as a whole is indicated by numeral 10. The apparatus includes a board 11 having a flat planer surface indicated in general by the numeral 12 which is divided into a plurality of rows and columns by a plurality of parallel grooves. For example, lines or grooves 13 and 14 are vertical to each other and are arranged in fixed spaced relationship with respect to the sides of the board 11 and are in fixed spaced apart relationship with respect to each other. By this means, at least three rows are defined and are represented by numerals 15, 16 and 17 respectively. By the same means of lines or grooves as indicated by numerals 18 and 19, at least three rows are defined and are illustrated by numerals 20, 21 and 22. Therefore, it can be seen that a plurality of playing squares are defined by the lines or grooves representing columns 15, 16 and 17 and columns 20, 21 and 22 respectively.

For purposes of illustration, the square defined by column 15 and row 21 is identified by numeral 23 and is representative of all of the other plurality of playing squares. Square 23 includes a circle 24 which encloses or encircles an "X" represented by numeral 25. The circle 24 includes a plurality of holes or apertures 26 and a similar number of holes or apertures are provided in the legs of the "X" 25 which are identified by numeral 27. In the present instance, the circle is provided with nine holes and the "X" is provided with a total of nine holes.

It is to be noted that each of the playing squares includes an identical circle and "X" pattern and that the visual pattern is important to the play of the game as well as the fact that identical numbers of holes are provided in the circle 24 as well as in the "X" 25. These factors influence the rules of play and enhance the entertainment value of the game.

Referring now in detail to FIG. 2, a fragmentary cross-section of the board 11 is illustrated so that a hole or aperture may be shown and in the present instance, numeral 27' indicates the center hole in the "X" 25 of playing square 23. A player's marker or token 30 is insertably received within the hole 27 so that it will stay in the insertable position during the course of play. The token or marker may take the form of a pin 31 having a handle 32 so that the player may readily grasp the token and insert or remove the token from the hole or aperture 27'. The token or marker 30 may take any form or configuration; however, in the present illustration, the marker is an insertable pin or peg and a suitable number of pegs are issued to each player at the commencement of the game for utilization throughout the play.

FIG. 2 further illustrates that each of the playing squares may be divided by a line or groove 13 so that the squares are well defined from each other and so that the respective playing squares forming the rows and columns of the planers surface provide a distinct visual pattern in addition to the distinctive visual pattern of each of the playing squares carrying the particular indicia.

FIG. 3 illustrates one example or form of a chance determining means which may take the form of a die 33. The die 33 is provided with a plurality of flat surfaces each of which display a different numerical value, such as the top surface in the illustration defining numerical value 1 and the sides having numerical values 2 and 5. The various faces of the die may be imprinted with numerals, dots or other indicia which indicate or are related to the number of pegs or tokens that a player may insert within the receptacles or holes 26 or 27 in the playing square. Any other suitable chance determining element or device may be employed, as for example, an arrow or pointer pivoted in such a manner so as to be spun, all of which are comprehended within the term "chance determining means." An alternate such means is illustrated in FIG. 4 which represents a set of playing cards which are of a standard deck having various numerical values established thereon. The standard deck of cards is illustrated by numeral 34 and may be used alternate to the die 33 or, in some games of chance, in combination therewith.

The number of players is not fixed. Any reasonable number can play but two players has been found to be most desirable. Starting a typical game, the players throw the standard die 33 and the one throwing the highest numerical value plays first. Play is then in rotation towards the left. Next, the player winning the right to first proceed, rolls the chance determining means or die 33 until either a 1 or a 6 appears and the player may place a marker or peg in any square of his choosing in either the circle or "X" position in that chosen square. In other words, the first player to roll a 1 or 6 chooses to continue playing the "X" or circle positions in the pattern of each of the squares.

After the game is started, the die is again rolled by each of the respective players in turn and the amount rolled on the die is employed to finish placing pegs to complete an "X" or circle; however, the number rolled on the die cannot be split between two playing squares. Every time a player rolls a 1 or 6, the player may start a new square or remove a pin from an opponents pattern in a playing square.

Therefore, the object of the game is to complete either three "X" patterns or three circle patterns in a straight line or vertically or horizontally corresponding to the rows and columns of the plurality of playing squares.

To further provide entertainment value for a game of play, an opponent may receive one last roll after a winning player has completed three of the "X" or three of the circle positions. If a 1 or 6 is rolled on the die 33, the opponent player has the right to remove a pin from the completed line or pattern of the winner player. After which, the other completing opponent then has to roll a 1 to win the game. In the event that this occurence is not achieved, the game continues until the squares are completed.

Therefore, in general, the game apparatus of the present invention provides a game board useful in the playing of a game somewhat similar to tick-tack-toe. The board surface is initially divided into nine squares forming identical and parallel rows and columns. Each playing square is provided with a printed pattern having a circular path with spaced apart holes and an "X" path or pattern within the circular path also having spaced apart holes. The number of holes in the circular path are the same as the number of holes in the "X" pattern. Each player or team uses pin tokens for moving and occupying the holes in the circular path and "X" pattern as determined by chance determining means such as dice or numbered cards. The player occupying the circular path or the "X" pattern of three adjacent squares would normally win the game.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A game board apparatus comprising:

a board having a flat, planar playing surface;

means carried on said playing surface dividing said playing surface into a plurality of parallel rows and parallel columns defining a plurality of playing squares;

each of said playing squares carries a pair of distinct and different patterns;

each of said playing square patterns including plurality of holes provided in said board conforming to said respective patterns;

multiple player tokens adapted to be insertably received into selected ones of said holes associated with a selected one of said distinct and different patterns; and chance determining means for indicating the number of said player tokens inserted into said selected pattern holes.

2. The invention as defined in claim 1 wherein said chance determining means is a die having numerical values imprinted on its faces.

3. The invention as defined in claim 1 wherein said chance determining means is a stack of playing cards having numerical values carried on the face of each of said cards.

4. The invention as defined in claim 1 wherein said pair of patterns include a circular path enclosing an X path.

5. The invention as defined in claim 4 wherein said number of holes in said patterns equal each other.

6. The invention as defined in claim 5 wherein said player token is a peg having finger gripping means at one end and a pin adapted to be insertably received into a selected one of said holes.

7. The invention as defined in claim 6 wherein said circular pattern carries a color different from the color of said X pattern.

8. The invention as defined in claim 7 wherein said board surface dividing means are grooves formed in said board.

* * * * *